US008887600B2

(12) United States Patent
Chen

(10) Patent No.: US 8,887,600 B2
(45) Date of Patent: Nov. 18, 2014

(54) ANTI-ABRASION OPEN END QUICK TURN WRENCH

(71) Applicant: Infar Industrial Co., Ltd., Chang-Hwa (TW)

(72) Inventor: Ander Chen, Chang-Hwa (TW)

(73) Assignee: Infar Industrial Co., Ltd., Chang-Hwa (TW)

( * ) Notice: Subject to any disclaimer, the term of this patent is extended or adjusted under 35 U.S.C. 154(b) by 232 days.

(21) Appl. No.: 13/667,886

(22) Filed: Nov. 2, 2012

(65) Prior Publication Data

US 2014/0041490 A1 Feb. 13, 2014

(30) Foreign Application Priority Data

Aug. 7, 2012 (TW) ..... 101128409 A

(51) Int. Cl.
*B25B 13/08* (2006.01)
*B25B 13/46* (2006.01)

(52) U.S. Cl.
USPC ..... 81/179; 81/186

(58) Field of Classification Search
CPC ..... B25B 13/08; B25B 13/12; B25B 13/46
USPC ..... 81/179, 186
See application file for complete search history.

(56) References Cited

U.S. PATENT DOCUMENTS

| | | | | |
|---|---|---|---|---|
| 1,308,440 | A * | 7/1919 | Morrison | 81/179 |
| 1,898,388 | A * | 2/1933 | Parker | 81/179 |
| 2,937,551 | A * | 5/1960 | Akers | 81/179 |
| 8,347,764 | B2 * | 1/2013 | Tuan-Mu et al. | 81/179 |
| 8,408,101 | B2 * | 4/2013 | Liu | 81/179 |
| 8,567,289 | B2 * | 10/2013 | Hu | 81/179 |
| 8,573,095 | B2 * | 11/2013 | Hu | 81/179 |
| 8,631,725 | B2 * | 1/2014 | Tuan-Mu | 81/179 |
| 2007/0119281 | A1 * | 5/2007 | Chang | 81/179 |
| 2013/0228052 | A1 * | 9/2013 | Wang | 81/179 |
| 2014/0007745 | A1 * | 1/2014 | Wu | 81/179 |

* cited by examiner

*Primary Examiner* — David B Thomas
(74) *Attorney, Agent, or Firm* — Wang Law Firm, Inc.; Li K. Wang; Stephen Hsu

(57) ABSTRACT

An anti-abrasion open end quick turn wrench is suitable for rotating a fastener with a head portion and includes: a body and an assistant engaging member. When the head portion of the fastener is completely engaged in the engaging slot, the wrench is provided with anti-abrasion concaves to provide enough room to prevent the open end wrench from interfering with the angles of the head portion of the fastener, and consequently preventing abrasion of the head portion of the fastener. Meanwhile, at least three lateral surfaces of the head portion of the fastener will be clamped by the wrench, when one or two of the clamped four lateral surfaces of the fastener is damaged or worn out, the fastener still has at least two intact lateral surfaces clamped by the open end quick turn wrench, so it can still be rotated by the wrench.

10 Claims, 6 Drawing Sheets

ANTI-ABRASION OPEN END QUICK TURN WRENCH

BACKGROUND OF THE INVENTION

1. Field of the Invention

The present invention relates to an open end wrench, and more particularly to an anti-abrasion open end quick turn wrench.

2. Description of the Prior Art

A wrench, no matter open-end wrench or box-end wrench, is usually unable to rotate in a full circle, when it works in a restricted space, so the wrench has to be removed from the fastener (being rotated by the wrench) after rotating a certain angle, and then the wrench has to engage with the fastener and rotate another angle, and so on so forth. Therefore, it is inconvenient and low efficient. To solve this problem, various quick turn open end wrenches which are capable of rotating continuously in a single direction have been developed.

As shown in FIG. 1, a conventional open end quick turn wrench comprises a body 11, a handle portion 111 for gripping, and a drive portion 112 connected to the handle portion 111 for rotating a fastener 12. The drive portion 112 includes an engaging slot 113 for engaging with a head portion 121 of the fastener 12. The engaging slot 113 includes a first engaging surface 1131, a second engaging surface 1132 and an inner surface 1133 between the first and second engaging surfaces 1131, 1132. In the inner surface 1133 is defined a cavity 114 in which being disposed a retractable assistant engaging member 13 which is provided with an abutting surface 131 to be abutted against a lateral surface 1211 of the head portion 121 of the fastener 12.

The head portion 121 of the fastener 12 is slidably received in the engaging slot 113 of the drive portion 112, and the first and second engaging surfaces 1131, 1132, and the assistant engaging member 13 will clamp the fastener 12 to rotate it in the first direction (the clockwise direction). When the head portion 121 of the fastener 12 is received in the engaging slot 113, the inner surface 1133 allows the drive portion 112 to idly rotate back in the second direction (the counterclockwise direction) with respect to the head portion 121 of the fastener 12, so that the fastener 12 can be rotated continuously. However, this wrench also suffers from the following disadvantages:

Firstly, when the head portion 121 of the fastener 12 is completely received in the engaging slot 113, and the drive portion 112 rotates in the second direction with respect to the head portion 121 of the fastener 12, the angle 1212 of the head portion 121 of the fastener 12 will interfere with the inner surface 1133 of the drive portion 112, causing abrasion of the angle 1212 of the head portion 121, and even worse, all the angles 1212 might be seriously abraded so that the fastener 12 cannot be rotated by the wrench anymore.

Secondly, when rotating the open end wrench in the first direction (the clockwise direction), only the first engaging surface 1131 and the abutting surface 131 of the assistant engaging member 13 clamp two opposite lateral surfaces 1211 of the head portion 121 of the fastener 12, once the two opposite lateral surfaces 1211 clamped by the wrench are worn off, the open end wrench won't be able to engage with and rotate the fastener 12 anymore. The open end wrench has to be disengaged from the fastener 12 and rotate an angle, then the wrench has to be clamp other two opposite lateral surfaces 1211 that are not worn off, so that the fastener 12 can be rotated again.

The present invention has arisen to mitigate and/or obviate the afore-described disadvantages.

SUMMARY OF THE INVENTION

The primary objective of the present invention is to provide an anti-abrasion open end quick turn wrench. When the head portion of the fastener is completely engaged in the engaging slot, the wrench is provided with anti-abrasion concaves to provide enough room to prevent the open end wrench from interfering with the angles of the head portion of the fastener, and consequently preventing abrasion of the head portion of the fastener.

Another objective of the present invention is to provide an anti-abrasion open end quick turn wrench. When the head portion of the fastener is completely engaged in the engaging slot, at least three lateral surfaces of the head portion of the fastener will be clamped by the wrench, when one or two of the clamped four lateral surfaces of the fastener is damaged or worn out, the fastener still has at least two intact lateral surfaces clamped by the open end quick turn wrench, so it can still be rotated by the wrench.

To achieve the above objectives, an anti-abrasion open end quick turn wrench in accordance with the present invention is suitable for rotating a fastener with a head portion. The head portion of the fastener includes at least a first lateral surface, a second lateral surface, a third lateral surface, a fourth lateral surface, and a fifth lateral surface, a first angle defined between the first and second lateral surfaces, a second angle defined between the second and third lateral surfaces, a third angle defined between the third and fourth lateral surfaces, a fourth angle defined between the fourth and fifth surfaces. The anti-abrasion open end quick turn wrench comprises: a body and an assistant engaging member.

The body is provided with a handle portion and a drive portion connected to the handle portion. The drive portion includes an engaging slot for engaging with the head portion of the fastener, the engaging slot includes a first clamping surface, a first abutting surface, a second abutting surface, a third abutting surface, and an arc-shaped concave surface and a second clamping surface. Between the first clamping surface and the first abutting surface is a first anti-abrasion concave, between the first abutting surface and the second abutting surface is a second anti-abrasion concave, and between the second abutting surface and the third abutting surface is formed a third anti-abrasion concave. The concave surface is formed with a cavity.

The assistant engaging member is retractably received in the cavity and includes a fourth anti-abrasion concave which is not exposed out of the cavity, and a press surface serving to press against the fifth lateral surface in such a manner that the part of the fifth lateral surface to be pressed against by the press surface is shorter than half of the width of the fifth lateral surface and located adjacent to the fourth lateral surface. When the head portion of the fastener is engaged in the engaging slot, and the press surface and the first abutting surface are clamped against the fifth and second lateral surfaces of the fastener, the first abutting surface will press against the second lateral surface of the fastener in such a manner that the part of the second lateral surface pressed against by the first abutting surface is shorter than half of the width of the second lateral surface and located adjacent to the first lateral surface, the third lateral surface of the fastener and the second abutting surface of the wrench are abutted against each other, and the second abutting surface will press against the third lateral surface of the fastener in such a manner that the part of the third lateral surface pressed against by the second abutting surface is shorter than half of the width of the third lateral surface and located adjacent to the second lateral surface, the fourth lateral surface of the fastener and the third abutting surface of the wrench are abutted against each other, the first angle is aligned with the first anti-abrasion concave, the second angle is aligned with the second anti-abrasion concave, the third angle is aligned with the third anti-abrasion concave, and the fourth angle is aligned with the arc-shaped concave surface.

Preferably, the assistant engaging member includes a spring, an assistant engaging head and a restricting member, the spring is received in the cavity, the assistant engaging head is retractably received in the cavity and includes a bottom surface for pushing against the spring, a positioning cavity, the press surface, and the fourth anti-abrasion concave, the restricting member is inserted in the positioning cavity to prevent the assistant engaging head from sliding out of the cavity.

Preferably, an angle between an extension surface of the press surface of the assistant engaging member and another extension surface which is perpendicular to the sixth lateral surface of the fastener ranges 10-30 degrees.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
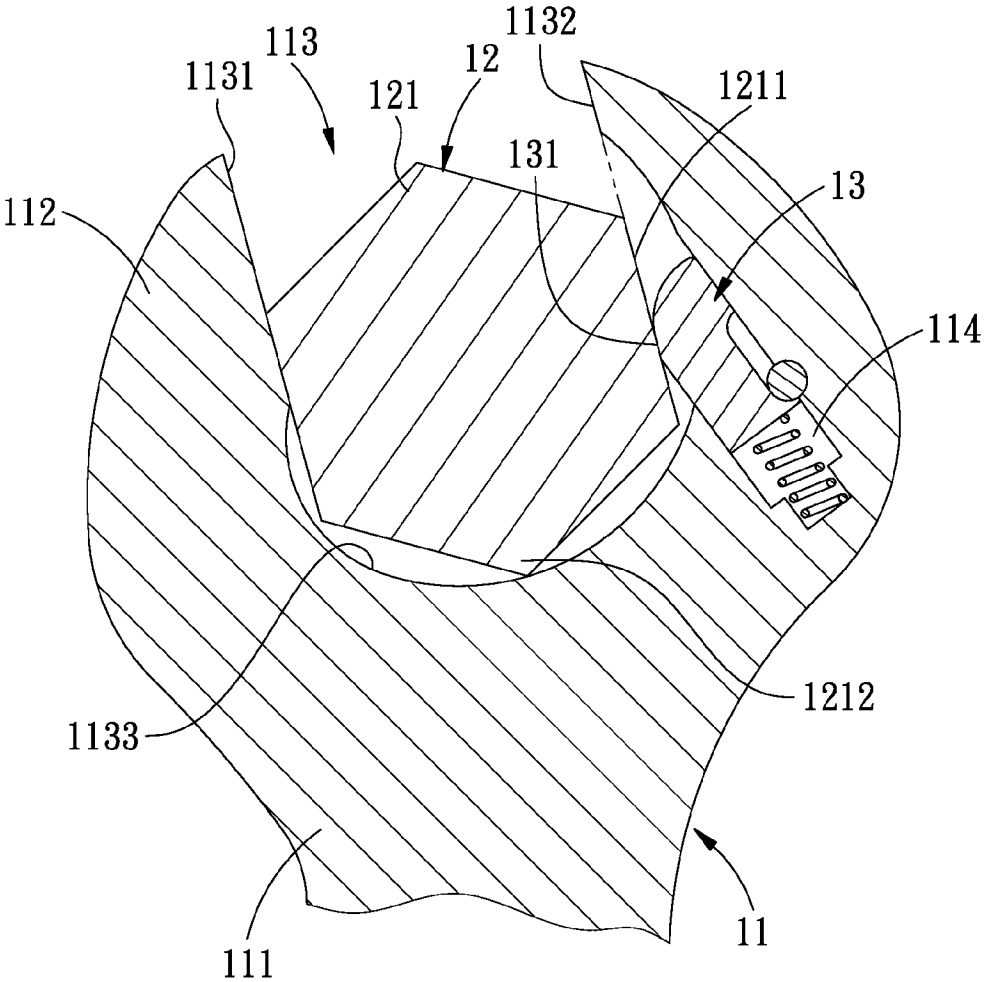
FIG. 1 PRIOR ART
FIG. 1 is a cross sectional view of a conventional open end quick turn wrench.
Figure 2:
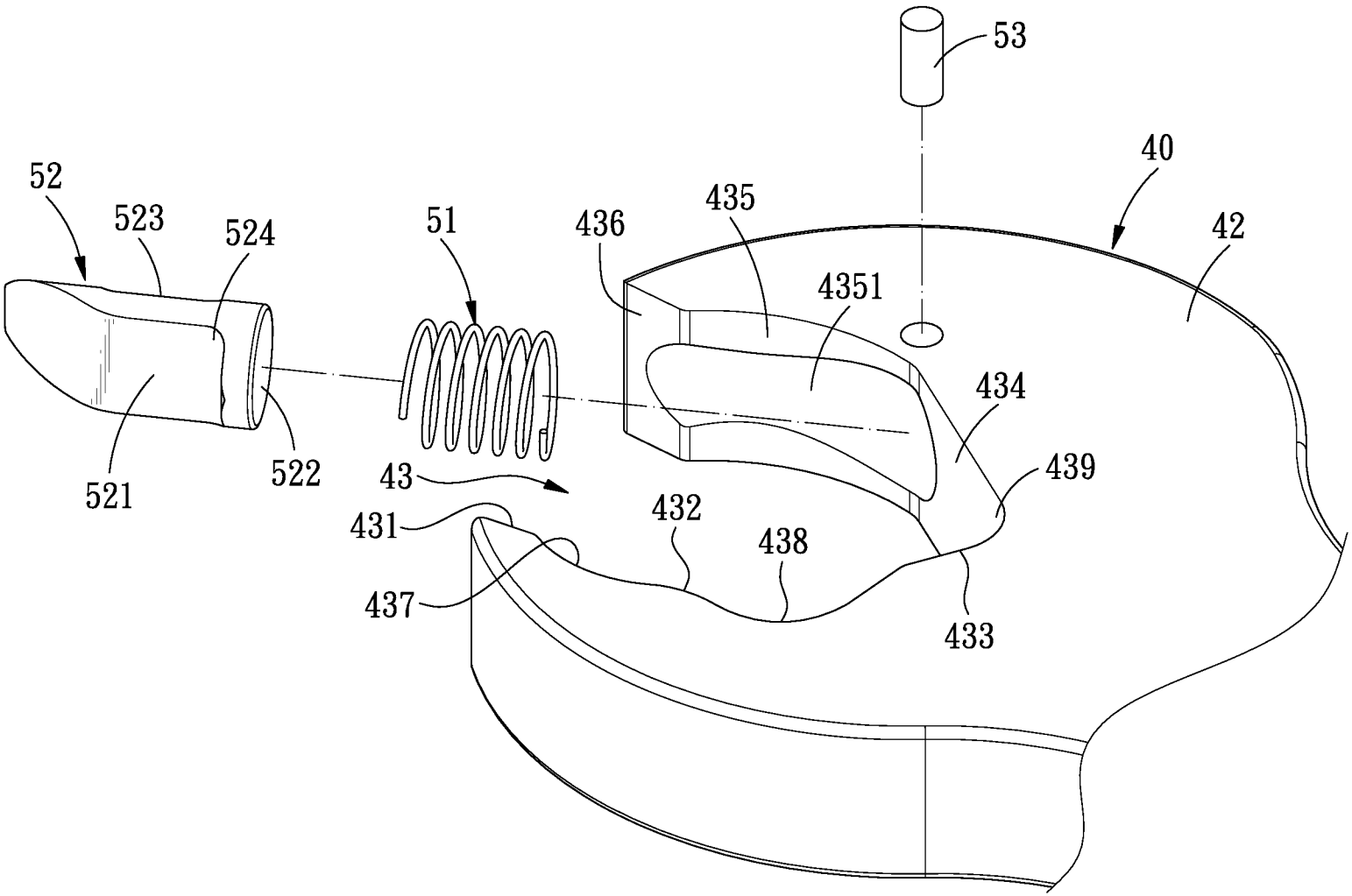
FIG. 2 is an exploded view of an anti-abrasion open end quick turn wrench in accordance with the present invention.
Figure 3:
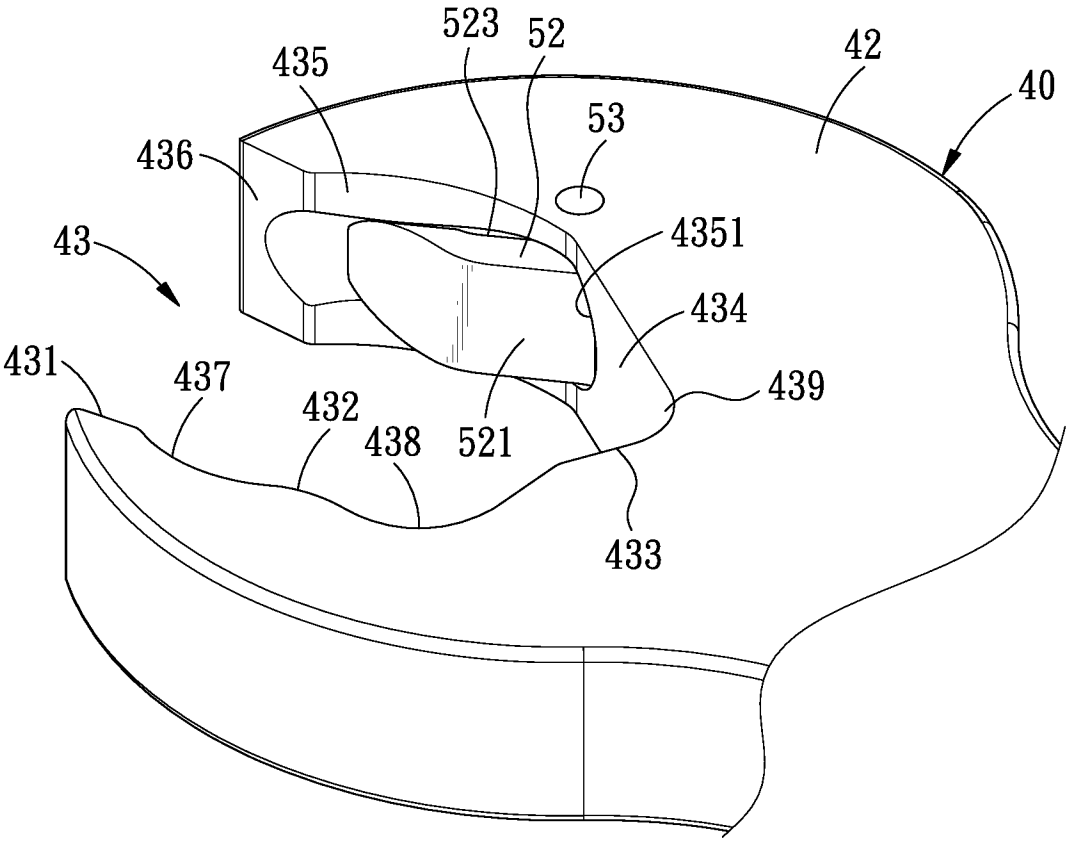
FIG. 3 is an assembly view of the anti-abrasion open end quick turn wrench in accordance with the present invention.
Figure 4:
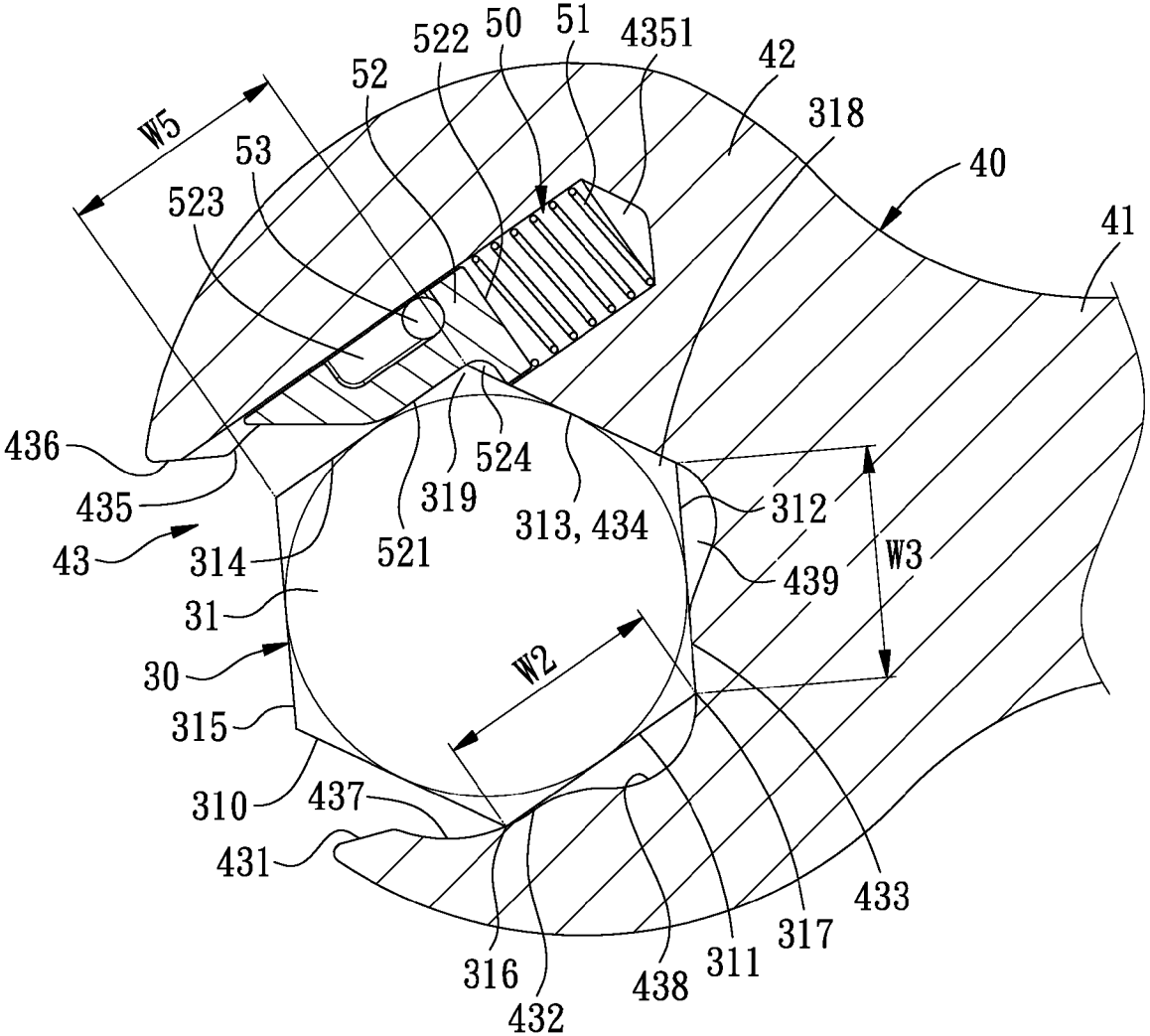
FIG. 4 is a cross sectional view of the anti-abrasion open end quick turn wrench in accordance with the present invention, wherein the drive portion is engaged with the head portion of the fastener.

Referring to FIGS. 2-4, an anti-abrasion open end quick turn wrench in accordance with the present invention is suitable for rotating a fastener 30 with a head portion 31 comprises a body 40 and an assistant engaging member 50. The head portion 31 of the fastener 30 includes fix lateral surfaces, which are: the first, second, third, fourth, fifth and sixth lateral surface 310, 311, 312, 313, 314 and 315. There is an angle between each two neighboring lateral surfaces, in other words, there are six angles in total, which are: the first angle 316 between the first and second lateral surfaces 310, 311, the second angle 317 between the second and third lateral surfaces 311, 312, the third angle 318 between the third and fourth lateral surfaces 312, 313, the fourth angle 319 between the fourth and fifth surfaces 313, 314, the fifth angle between the fifth and sixth lateral surfaces 314, 315, and the sixth angle between the sixth and first lateral surfaces 315, 310.

The body 40 includes a handle portion 41 and a drive portion 42 connected to the handle portion 41. The drive portion 42 includes an engaging slot 43 for engaging with the head portion 31 of the fastener 30. The engaging slot 43 includes a first clamping surface 431, a first abutting surface 432, a second abutting surface 433, a third abutting surface 434, and an arc-shaped concave surface 435 and a second clamping surface 436. Between the first clamping surface 431 and the first abutting surface 432 is a first anti-abrasion concave 437, between the first abutting surface 432 and the second abutting surface 433 is a second anti-abrasion concave 438, and between the second abutting surface 433 and the third abutting surface 434 is a third anti-abrasion concave 439. The concave surface 435 is formed with a cavity 4351.

The assistant engaging member 50 is retractably received in the cavity 4351 and includes a fourth anti-abrasion concave 524 which is not exposed out of the cavity 5351, and a press surface 521 for pressing against the fifth lateral surface 314. The part of the fifth lateral surface 314 to be pressed against by the press surface 521 is shorter than half of the width W5 of the fifth lateral surface 314 and located adjacent to the fourth lateral surface 313. The width W5 of the fifth lateral surface 314 refers to the distance between two ends of the fifth lateral surface 314, which are connected to the fourth and sixth lateral surfaces 313, 315, respectively. In this embodiment, the assistant engaging member 50 includes a spring 51, an assistant engaging head 52 and a restricting member 53. The spring 51 is received in the cavity 4351. The assistant engaging head 52 is retractably received in the cavity 4351 and includes a bottom surface 522 for pushing against the spring 51, a positioning cavity 523, the press surface 521, and the fourth anti-abrasion concave 524. The restricting member 53 is inserted in the positioning cavity 523 to prevent the assistant engaging head 52 from sliding out of the cavity 4351. When the head portion 31 of the fastener 30 is engaged in the engaging slot 43, and the press surface 521 and the first abutting surface 432 are clamped against the fifth and second lateral surfaces 314, 311 of the fastener 30, the first abutting surface 432 will press against the second lateral surface 311 of the fastener 30 in such a manner that the part of the second lateral surface 311 pressed against by the first abutting surface 432 is shorter than half of the width W2 of the second lateral surface 311 and located adjacent to the first lateral surface 310. The width W2 of the second lateral surface 311 refers to the distance between two ends of the second lateral surface 311, which are connected to the first and third lateral surfaces 310, 312, respectively. The third lateral surface 312 of the fastener 30 and the second abutting surface 433 of the wrench are abutted against each other, and the second abutting surface 433 will press against the third lateral surface 312 of the fastener 30 in such a manner that the part of the third lateral surface 312 pressed against by the second abutting surface 433 is shorter than half of the width W3 of the third lateral surface 312 and located adjacent to the second lateral surface 311. The width W3 of the third lateral surface 312 refers to the distance between two ends of the third lateral surface 312, which are connected to the second and fourth lateral surfaces 311, 313, respectively. The fourth lateral surface 313 of the fastener 30 and the third abutting surface 434 of the wrench are abutted against each other, the first angle 316 is aligned with the first anti-abrasion concave 437, the second angle 317 is aligned with the second anti-abrasion concave 438, the third angle 318 is aligned with the third anti-abrasion concave 439, and the fourth angle 319 is aligned and not in contact with the arc-shaped concave surface 435.

Referring back to FIG. 4, when the head portion 31 of the fastener 30 is completely engaged in the engaging slot 43, the second, third, forth and fifth lateral surfaces 311, 312, 313, 314 of the head portion 31 will be pressed against the first, second and third abutting surfaces 432, 433, 434 of the drive portion 42, and the press surface 521 of the assistant engaging member 50, respectively. Meanwhile, the first, second, and third angles 316, 317 and 318 of the fastener 30 will be aligned with the first, second, third anti-abrasion concaves 437, 438 and 439, respectively, and the fourth angle 319 of the fastener 30 will be aligned but won't be in contact with the arc-shaped concave surface 435. At this moment, the clockwise and counterclockwise rotations of the open end quick turn wrench of the present invention are explained as follows:

When the open end quick turn wrench in accordance with the present invention is turned in counterclockwise direction, the first, second, and third angles 316, 317 and 318 of the fastener 30 will be aligned with the first, second, third anti-abrasion concaves 437, 438 and 439, respectively, and the fourth angle 319 of the fastener 30 will be aligned but won't be in contact with the arc-shaped concave surface 435, which will provide enough room to prevent the open end wrench from interfering with the angles of the head portion 31 of the fastener 30 when the wrench is rotated counterclockwise, and consequently preventing abrasion of the head portion 31 of the fastener 30. Meanwhile, the anti-abrasion concaves provide room for the angles of the head portion 31 of the fastener 30, allowing the wrench to repeatedly rotate idly back to its operating position.

When the open end quick turn wrench rotates in clockwise direction to turn the fastener, the second, third, forth and fifth lateral surfaces 311, 312, 313, 314 of the head portion 31 will be pressed against the first, second and third abutting surfaces 432, 433, 434 of the drive portion 42, and the press surface 521 of the assistant engaging member 50, respectively. At least three lateral surfaces of the head portion 31 of the fastener 30 will be clamped by the wrench, when one or two of the clamped four lateral surfaces of the fastener 30 is damaged or worn out, the fastener 30 still has at least two intact lateral surfaces clamped by the open end quick turn wrench, so it can still be rotated by the wrench.

Figure 5:
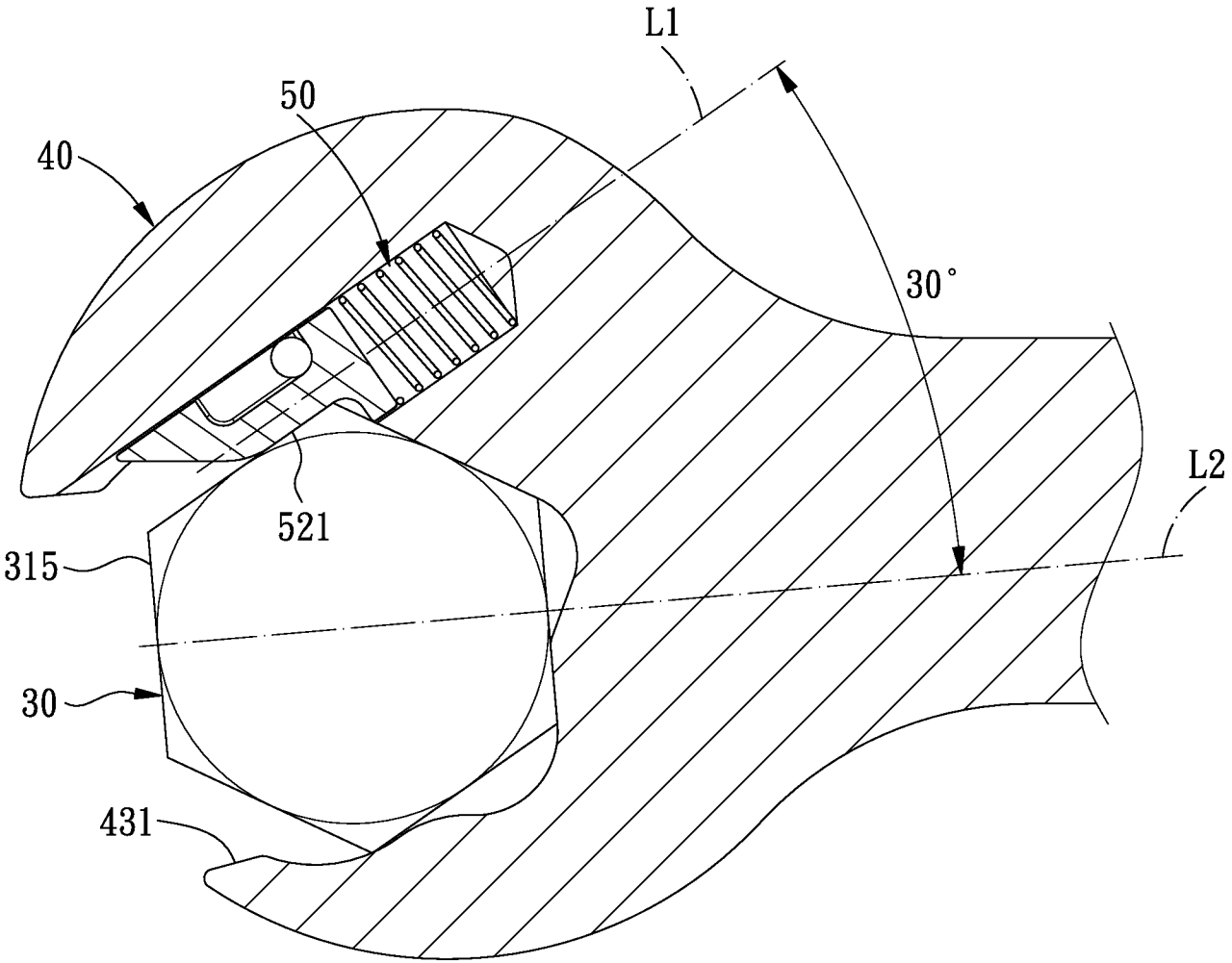
FIG. 5 is a cross sectional view of the anti-abrasion open end quick turn wrench in accordance with the present invention, showing an angle between the first clamping surface of the body of the wrench and the press surface of the assistant engaging member.

Referring to FIG. 5, an angle between an extension surface of the press surface 521 of the assistant engaging member 50 and an extension surface which is perpendicular to the sixth lateral surface 315 of the fastener 30 is 10-30 degrees, wherein the first dotted line L1 is in parallel to the press surface 521 and serves as the extension surface of the press surface 521, and the second dotted line L2 is perpendicular to the sixth lateral surface 315 of the fastener 30 and can serve as the extension surface of the sixth lateral surface 315 of the fastener 30.

Figure 6:
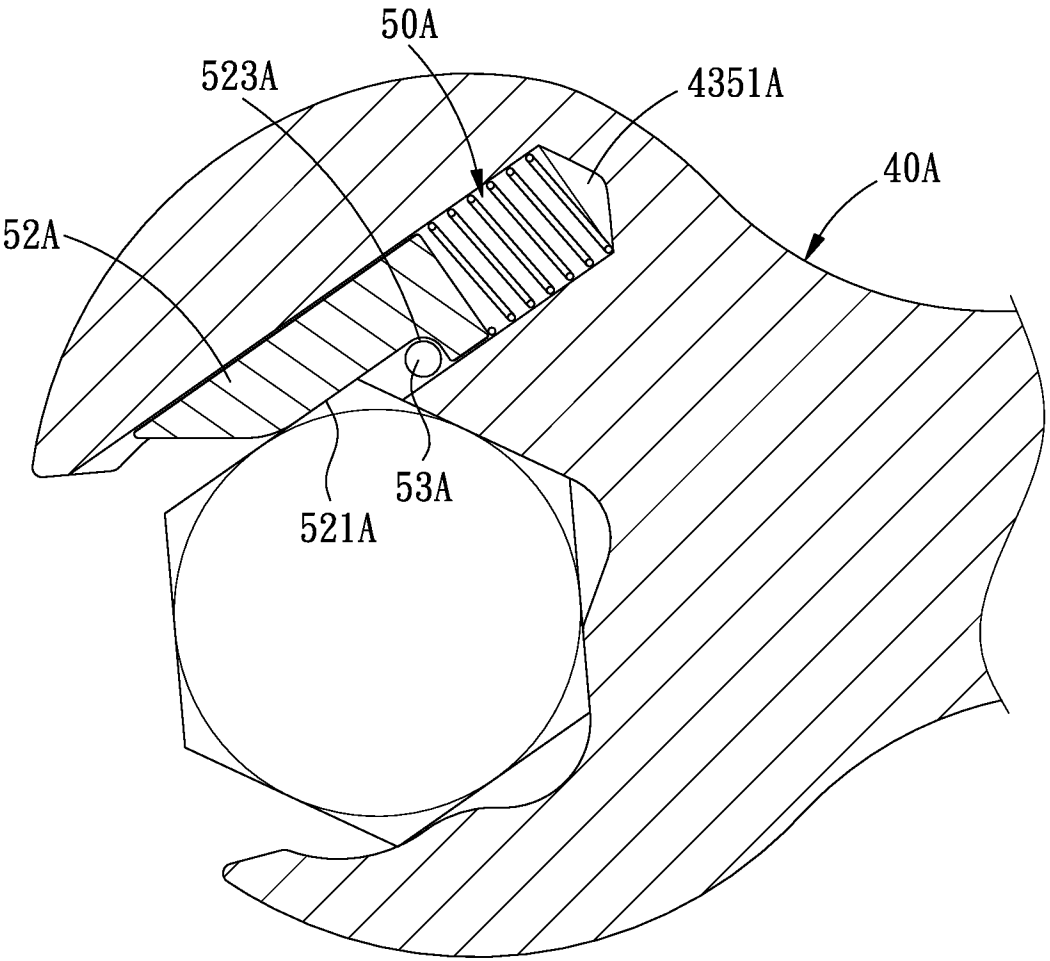
FIG. 6 shows another embodiment of the assistant engaging head of the assistant engaging member of the present invention, wherein the positioning cavity and the press surface are located at the same side.

Referring then to FIG. 6, which shows another embodiment of the assistant engaging head 52A of the assistant engaging member 50A, wherein the positioning cavity 523A and the press surface 521A are located at the same side, and the assistant engaging member 50A doesn't have a fourth anti-abrasion concave. After the restricting member 53A is inserted in the positioning cavity 523A, it can also prevent the assistant engaging head 52A from sliding out of the cavity 4351A of the body 40A.

While we have shown and described various embodiments in accordance with the present invention, it is clear to those skilled in the art that further embodiments may be made without departing from the scope of the present invention.

What is claimed is:

1. An anti-abrasion open end quick turn wrench suitable for rotating a fastener with a head portion, the head portion of the fastener including at least a first lateral surface, a second lateral surface, a third lateral surface, a fourth lateral surface, and a fifth lateral surface, a first angle defined between the first and second lateral surfaces, a second angle defined between the second and third lateral surfaces, a third angle defined between the third and fourth lateral surfaces, a fourth angle defined between the fourth and fifth surfaces; the anti-abrasion open end quick turn wrench comprising:

a body with a handle portion and a drive portion connected to the handle portion, the drive portion including an engaging slot for engaging with the head portion of the fastener, the engaging slot including a first clamping surface, a first abutting surface, a second abutting surface, a third abutting surface, and an arc-shaped concave surface and a second clamping surface, between the first clamping surface and the first abutting surface being formed a first anti-abrasion concave, between the first abutting surface and the second abutting surface being formed a second anti-abrasion concave, and between the second abutting surface and the third abutting surface being formed a third anti-abrasion concave, the concave surface being formed with a cavity;

an assistant engaging member retractably received in the cavity and including a fourth anti-abrasion concave which is not exposed out of the cavity, and a press surface serving to press against the fifth lateral surface in such a manner that the part of the fifth lateral surface to be pressed against by the press surface is shorter than half of the width of the fifth lateral surface and located adjacent to the fourth lateral surface, when the head portion of the fastener is engaged in the engaging slot, and the press surface and the first abutting surface are clamped against the fifth and second lateral surfaces of the fastener, the first abutting surface will press against the second lateral surface of the fastener in such a manner that the part of the second lateral surface pressed against by the first abutting surface is shorter than half of the width of the second lateral surface and located adjacent to the first lateral surface, the third lateral surface of the fastener and the second abutting surface of the wrench are abutted against each other, and the second abutting surface will press against the third lateral surface of the fastener in such a manner that the part of the third lateral surface pressed against by the second abutting surface is shorter than half of the width of the third lateral surface and located adjacent to the second lateral surface, the fourth lateral surface of the fastener and the third abutting surface of the wrench are abutted against each other, the first angle is aligned with the first anti-abrasion concave, the second angle is aligned with the second anti-abrasion concave, the third angle is aligned with the third anti-abrasion concave, and the fourth angle is aligned with the arc-shaped concave surface.

2. The anti-abrasion open end quick turn wrench as claimed in claim 1, wherein the assistant engaging member includes a spring, an assistant engaging head and a restricting member, the spring is received in the cavity, the assistant engaging head is retractably received in the cavity and includes a bottom surface for pushing against the spring, a positioning cavity, the press surface, and the fourth anti-abrasion concave, the restricting member is inserted in the positioning cavity to prevent the assistant engaging head from sliding out of the cavity.

3. The anti-abrasion open end quick turn wrench as claimed in claim 1, wherein an angle between an extension surface of the press surface of the assistant engaging member and another extension surface which is perpendicular to the sixth lateral surface of the fastener ranges 10-30 degrees.

4. An anti-abrasion open end quick turn wrench suitable for rotating a fastener with a head portion, the head portion of the fastener including at least a first lateral surface, a second lateral surface, a third lateral surface, a fourth lateral surface, and a fifth lateral surface, a first angle defined between the first and second lateral surfaces, a second angle defined between the second and third lateral surfaces, a third angle defined between the third and fourth lateral surfaces, a fourth angle defined between the fourth and fifth surfaces; the anti-abrasion open end quick turn wrench comprising:

a body with a handle portion and a drive portion connected to the handle portion, the drive portion including an engaging slot for engaging with the head portion of the fastener, the engaging slot including a first clamping surface, a first abutting surface, a second abutting surface, a third abutting surface, and an arc-shaped concave surface and a second clamping surface, between the first clamping surface and the first abutting surface being formed a first anti-abrasion concave, between the first abutting surface and the second abutting surface being formed a second anti-abrasion concave, and between the second abutting surface and the third abutting surface being formed a third anti-abrasion concave, the concave surface being formed with a cavity;

an assistant engaging member retractably received in the cavity and including a press surface serving to press against the fifth lateral surface in such a manner that the part of the fifth lateral surface to be pressed against by the press surface is shorter than half of the width of the fifth lateral surface and located adjacent to the fourth lateral surface, when the head portion of the fastener is engaged in the engaging slot, and the press surface and the first abutting surface are clamped against the fifth and second lateral surfaces of the fastener, the first abutting surface will press against the second lateral surface of the fastener in such a manner that the part of the second lateral surface pressed against by the first abutting surface is shorter than half of the width of the second lateral surface and located adjacent to the first lateral surface, the fourth lateral surface of the fastener and the third abutting surface of the wrench are abutted against each other, the first angle is aligned with the first anti-abrasion concave, the second angle is aligned with the second anti-abrasion concave, the third angle is aligned with the third anti-abrasion concave, and the fourth angle is aligned with the arc-shaped concave surface.

5. The anti-abrasion open end quick turn wrench as claimed in claim 4, wherein the assistant engaging member includes a spring, an assistant engaging head and a restricting member, the spring is received in the cavity, the assistant engaging head is retractably received in the cavity and includes a bottom surface for pushing against the spring, a positioning cavity, the press surface, and the fourth anti-abrasion concave, the restricting member is inserted in the positioning cavity to prevent the assistant engaging head from sliding out of the cavity.

6. The anti-abrasion open end quick turn wrench as claimed in claim 4, wherein an angle between an extension surface of the press surface of the assistant engaging member and another extension surface which is perpendicular to the sixth lateral surface of the fastener ranges 10-30 degrees.

7. The anti-abrasion open end quick turn wrench as claimed in claim 4, wherein the third lateral surface of the fastener and the second abutting surface of the wrench are abutted against each other, and the second abutting surface will press against the third lateral surface of the fastener in such a manner that the part of the third lateral surface pressed against by the second abutting surface is shorter than half of the width of the third lateral surface and located adjacent to the second lateral surface.

8. An anti-abrasion open end quick turn wrench suitable for rotating a fastener with a head portion, the head portion of the fastener including at least a first lateral surface, a second lateral surface, a third lateral surface, a fourth lateral surface, and a fifth lateral surface, a first angle defined between the first and second lateral surfaces, a second angle defined between the second and third lateral surfaces, a third angle defined between the third and fourth lateral surfaces, a fourth angle defined between the fourth and fifth surfaces; the anti-abrasion open end quick turn wrench comprising:

a body with a handle portion and a drive portion connected to the handle portion, the drive portion including an engaging slot for engaging with the head portion of the fastener, the engaging slot including a first clamping surface, a first abutting surface, a second abutting surface, a third abutting surface, and an arc-shaped concave surface and a second clamping surface, between the first clamping surface and the first abutting surface being formed a first anti-abrasion concave, between the first abutting surface and the second abutting surface being formed a second anti-abrasion concave, and between the second abutting surface and the third abutting surface being formed a third anti-abrasion concave, the concave surface being formed with a cavity;

an assistant engaging member retractably received in the cavity and including a press surface serving to press against the fifth lateral surface in such a manner that the part of the fifth lateral surface to be pressed against by the press surface is shorter than half of the width of the fifth lateral surface and located adjacent to the fourth lateral surface, when the head portion of the fastener is engaged in the engaging slot, and the press surface and the first abutting surface are clamped against the fifth and second lateral surfaces of the fastener, the first abutting surface will press against the second lateral surface of the fastener in such a manner that the part of the second lateral surface pressed against by the first abutting surface is shorter than half of the width of the second lateral surface and located adjacent to the first lateral surface, the third lateral surface of the fastener and the second abutting surface of the wrench are abutted against each other, and the second abutting surface will press against the third lateral surface of the fastener in such a manner that the part of the third lateral surface pressed against by the second abutting surface is shorter than half of the width of the third lateral surface and located adjacent to the second lateral surface, the first angle is aligned with the first anti-abrasion concave, the second angle is aligned with the second anti-abrasion concave, the third angle is aligned with the third anti-abrasion concave, and the fourth angle is aligned with the arc-shaped concave surface.

9. The anti-abrasion open end quick turn wrench as claimed in claim 8, wherein the assistant engaging member includes a spring, an assistant engaging head and a restricting member, the spring is received in the cavity, the assistant engaging head is retractably received in the cavity and includes a bottom surface for pushing against the spring, a positioning cavity, the press surface, and the fourth anti-abrasion concave, the restricting member is inserted in the positioning cavity to prevent the assistant engaging head from sliding out of the cavity.

10. The anti-abrasion open end quick turn wrench as claimed in claim 8, wherein an angle between an extension surface of the press surface of the assistant engaging member and another extension surface which is perpendicular to the first lateral surface of the fastener ranges 10-30 degrees, the fourth lateral surface and the third abutting surface are abutted against each other.

* * * * *